US006447261B1

(12) United States Patent
McCook

(10) Patent No.: US 6,447,261 B1
(45) Date of Patent: Sep. 10, 2002

(54) PORTABLE BILGE PUMP ASSEMBLY

(76) Inventor: James V. McCook, 11543 101st St., Largo, FL (US) 33773

( * ) Notice: Subject to any disclaimer, the term of this patent is extended or adjusted under 35 U.S.C. 154(b) by 0 days.

(21) Appl. No.: 09/759,008

(22) Filed: Jan. 12, 2001

(51) Int. Cl.[7] ..... F04B 53/00
(52) U.S. Cl. ..... 417/234; 417/423.3; 417/423.14
(58) Field of Search ..... 417/234, 411, 417/423.3, 423.14

(56) References Cited

U.S. PATENT DOCUMENTS 3,748,066 A 7/1973 Sully et al.
3,776,666 A * 12/1973 Ludwig ..... 417/411
3,941,073 A * 3/1976 Ridgeway ..... 114/183 R
4,057,366 A * 11/1977 Niemann ..... 417/234
4,218,195 A * 8/1980 Shure ..... 417/411
4,502,515 A * 3/1985 Kobayashi et al. ..... 141/195
4,552,515 A * 11/1985 Endo ..... 417/472
4,607,400 A 8/1986 Goodman
4,645,426 A * 2/1987 Hartley et al. ..... 417/38
D296,103 S 6/1988 Harvey
5,094,591 A * 3/1992 Whitley, II et al. ..... 417/234
6,290,469 B1 * 9/2001 Archibald ..... 417/234

* cited by examiner

*Primary Examiner*—Cheryl J. Tyler
*Assistant Examiner*—Han Lieh Liu

(57) ABSTRACT

A portable bilge pump assembly for providing portable water pumping capabilities without an external power source. The portable bilge pump assembly includes a pump member which is submersible and designed for pumping water, a hose member which is environmentally coupled to the pump member and designed for carrying water from the pump member to an area selected by the user for dumping, and an handle assembly which is pivotally coupled to the pump member and used for positioning the pump member.

11 Claims, 3 Drawing Sheets

PORTABLE BILGE PUMP ASSEMBLY

BACKGROUND OF THE INVENTION

1. Field of the Invention

The present invention relates to water pumps and more particularly pertains to a new portable bilge pump assembly for providing portable water pumping capabilities without an external power source.

2. Description of the Prior Art

The use of water pumps is known in the prior art. More specifically, water pumps heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. Nos. 4,057,366; 4,552,515; 3,941,073; 3,748,066; and Des. 296,103.

While these devices fulfill their respective, particular objectives and requirements, the aforementioned patents do not disclose a new portable bilge pump assembly. The inventive device includes a pump member which is submersible and designed for pumping water, a hose member which is environmentally coupled to the pump member and designed for carrying water from the pump member to an area selected by the user for dumping, and an handle assembly which is pivotally coupled to the pump member and used for positioning the pump member.

In these respects, the portable bilge pump assembly according to the present invention substantially departs from the conventional concepts and designs of the prior art, and in so doing provides an apparatus primarily developed for the purpose of providing portable water pumping capabilities without an external power source.

SUMMARY OF THE INVENTION

In view of the foregoing disadvantages inherent in the known types of water pumps now present in the prior art, the present invention provides a new portable bilge pump assembly construction wherein the same can be utilized for providing portable water pumping capabilities without an external power source.

The general purpose of the present invention, which will be described subsequently in greater detail, is to provide a new portable bilge pump assembly apparatus and method which has many of the advantages of the water pumps mentioned heretofore and many novel features that result in a new portable bilge pump assembly which is not anticipated, rendered obvious, suggested, or even implied by any of the prior art water pumps, either alone or in any combination thereof.

To attain this, the present invention generally comprises a pump member which is submersible and designed for pumping water, a hose member which is environmentally coupled to the pump member and designed for carrying water from the pump member to an area selected by the user for dumping, and an handle assembly which is pivotally coupled to the pump member and used for positioning the pump member.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new portable bilge pump assembly apparatus and method which has many of the advantages of the water pumps mentioned heretofore and many novel features that result in a new portable bilge pump assembly which is not anticipated, rendered obvious, suggested, or even implied by any of the prior art water pumps, either alone or in any combination thereof.

It is another object of the present invention to provide a new portable bilge pump assembly which may be easily and efficiently manufactured and marketed.

It is a further object of the present invention to provide a new portable bilge pump assembly which is of a durable and reliable construction.

An even further object of the present invention is to provide a new portable bilge pump assembly which is susceptible of a low cost of manufacture with regard to both materials and labor, and which accordingly is then susceptible of low prices of sale to the consuming public, thereby making such portable bilge pump assembly economically available to the buying public.

Still yet another object of the present invention is to provide a new portable bilge pump assembly which provides in the apparatuses and methods of the prior art some of the advantages thereof, while simultaneously overcoming some of the disadvantages normally associated therewith.

Still another object of the present invention is to provide a new portable bilge pump assembly for providing portable water pumping capabilities without an external power source.

Yet another object of the present invention is to provide a new portable bilge pump assembly which includes a pump member which is submersible and designed for pumping water, a hose member which is environmentally coupled to the pump member and designed for carrying water from the pump member to an area selected by the user for dumping, and an handle assembly which is pivotally coupled to the pump member and used for positioning the pump member.

Still yet another object of the present invention is to provide a new portable bilge pump assembly that is compatible with standard cell type batteries or can be recharged.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
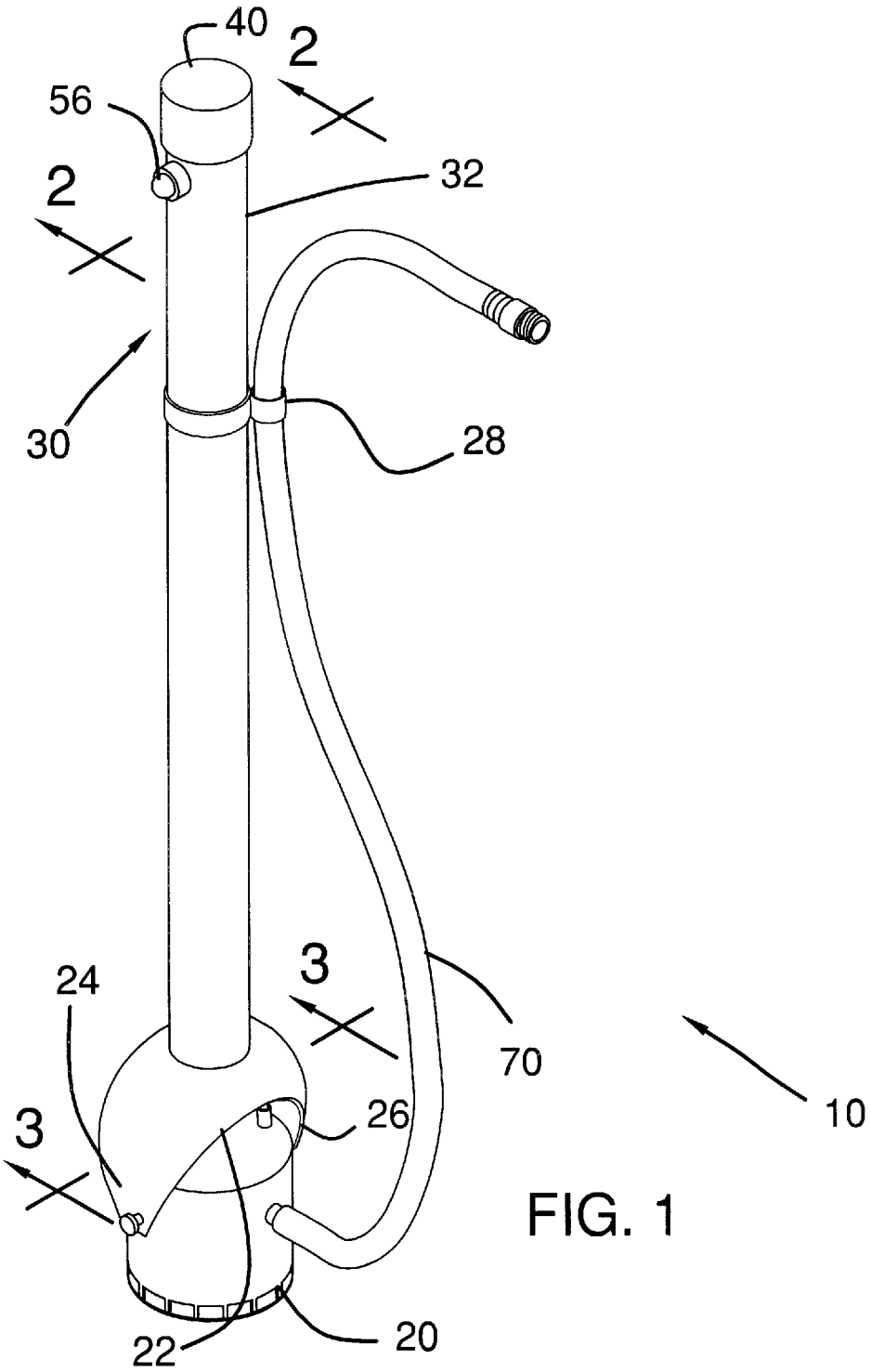
FIG. 1 is a schematic perspective view of a new portable bilge pump assembly according to the present invention.
Figure 2:
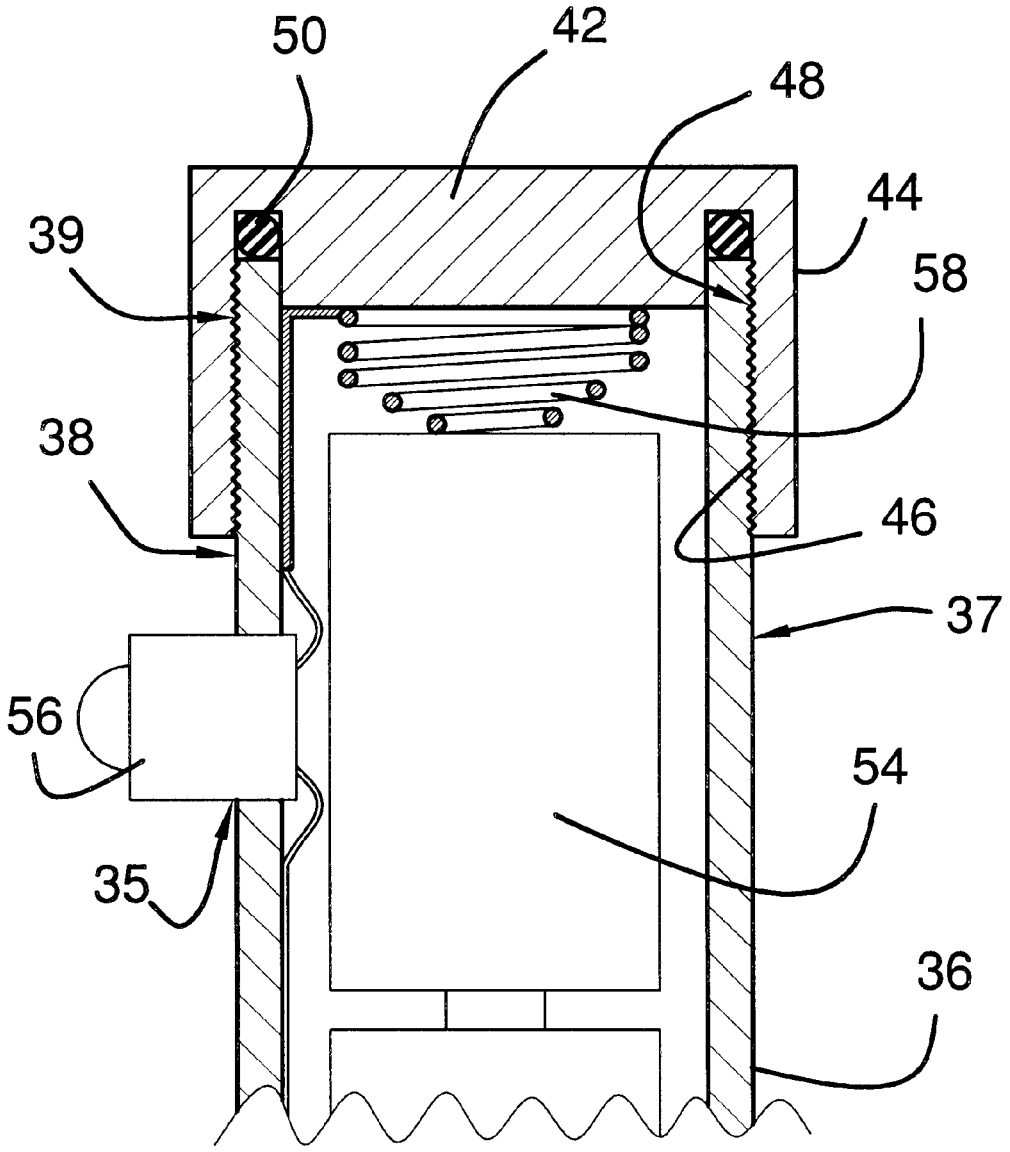
FIG. 2 is a schematic cross-sectional detail view of the cap portion of the present invention taken along line 2—2 of FIG. 1.
Figure 3:
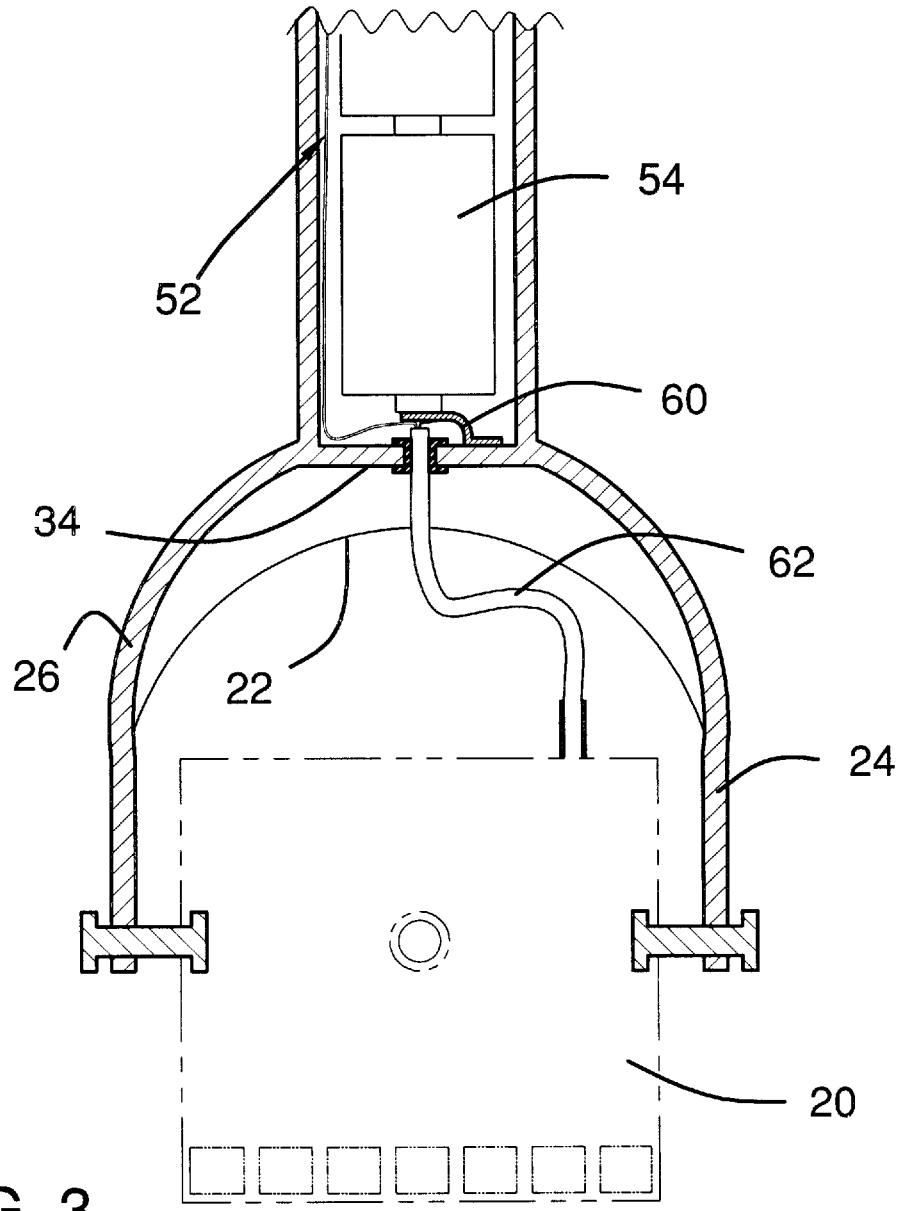
FIG. 3 is a schematic cross-sectional view of the pump and handle portion of the present invention taken along line 3—3 of FIG. 1.

With reference now to the drawings, and in particular to FIGS. 1 through 3 thereof, a new portable bilge pump assembly embodying the principles and concepts of the present invention and generally designated by the reference numeral 10 will be described.

As best illustrated in FIGS. 1 through 3, the portable bilge pump assembly 10 generally comprises a pump member 20, a hose member 70, and an handle assembly 30.

The pump member 20 is submersible and designed for pumping water.

The hose member 70 is environmentally coupled to the pump member 20 and designed for carrying water from the pump member 20 to an area selected by the user for dumping.

The handle assembly 30 is pivotally coupled to the pump member 20. The handle member 30 is for positioning the pump member 20.

In an embodiment the handle assembly 30 further comprises an housing 32, a cap member 40, an o-ring member 50, and an electrical energy storage assembly 52. The housing 32 is substantially elongate and tubular. The housing 32 includes an end portion 34 and a tubular perimeter wall 36, which extends from the end portion 34. The tubular perimeter wall 36 includes a distal end 37. The distal end 37 further includes an exterior surface 38 with threads 39 applied thereon. The cap member 40 includes a circular end portion 42 and a perimeter wall 44 extending therefrom. The perimeter wall 44 includes an interior surface 46 with threads 48 applied thereon such that the cap member 40 is threadedly engageable to the housing 32. The o-ring member 50 is positioned between the cap member 40 and the housing 32. The o-ring member 50 provides an environmental barrier between an external environment and an interior of the housing 32. The electrical energy storage assembly 52 is positioned within the housing 32. The electrical energy storage assembly 52 provides electrical power for the pump member 20.

In a further embodiment the electrical storage assembly 52 comprises a plurality of standard C-cell batteries 54 electrically connected in series.

In still a further embodiment the housing 32 further comprises a clip member 28, which extends from a medial portion of the housing 32. The clip member 28 is used for retaining the hose member 70 in a relatively static position in relationship to the housing 32.

A switch member 56 is positioned in an aperture 35, which extends through the perimeter wall 36 of the housing 32. The switch member 56 is electrically connected between the pump member 20 and the electrical storage assembly 52 such that when the switch member 56 is in a closed position the pump member 20 operates and when the switch member 56 is in an open position the pump member 20 does not operate.

A biasing assembly 58 is designed for urging the electrical storage assembly 52 towards an electrical contact 60 positioned at a bottom of the housing 32.

A first 26 and second arm 24 each extend outwardly from the end portion 34 of the housing 32. The first 26 and second arms 24 are pivotally coupled to the pump member 20.

A shroud member 22 is substantially arcuate. The shroud member 22 extends from the first arm 26 to the second arm 24 for protecting an electrical wire 62, which extends from the housing 32 to the pump member 20.

In use, the hose is positioned such that the open end is located where the user want to dump the water being pumped such as over the side of a boat. The user positions the pump using the handle assembly. When the pump is positioned as desired and submerged the switch on the handle assembly is placed in the closed position and the pump works in the conventional manner.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A portable bilge pump assembly comprising:

a pump member, said pump member being submersible and adapted for pumping water;

a hose member environmentally coupled to said pump member and adapted for carrying water from said pump member to an area selected by the user for dumping;

a handle assembly pivotally coupled to said pump member, said handle member being for positioning said pump member;

a housing, said housing being substantially elongate, said housing being substantially tubular, said housing having an end portion and a tubular perimeter wall extending from said end portion, said tubular perimeter wall having a distal end, said distal end having an exterior surface with threads applied thereon;

a cap member having a circular end portion and a perimeter wall extending therefrom, said perimeter wall having an interior surface with threads applied thereon such that said cap member is threadedly engageable to said housing;

an o-ring member positioned between said cap member and said housing, said o-ring member providing an environmental barrier between an external environment and an interior of said housing.

2. The portable bilge pump assembly of claim 1, further comprising:

a electrical energy storage assembly positioned within said housing, said electrical energy storage assembly providing electrical power for said pump member.

3. The portable bilge pump assembly of claim 2 wherein said electrical storage assembly comprises a plurality of standard C-cell batteries electrically connected in series.

4. The portable bilge pump assembly of claim 2 wherein said electrical storage assembly comprises a plurality of rechargeable cell batteries electrically connected in series.

5. The portable bilge pump assembly of claim 2 wherein said electrical storage assembly comprises a single tubular battery pack.

6. The portable bilge pump assembly of claim 2 further comprising:

a switch member, said switch member being positioned in an aperture extending through said perimeter wall of said housing, said switch member being electrically connected between said pump member and said electrical storage assembly such that when said switch member is in a closed position said pump member operates and when said switch member is in an open position said pump member does not operate.

7. The portable bilge pump assembly of claim 2, wherein said cap member further comprises a biasing assembly adapted for urging said electrical storage assembly towards an electrical contact positioned at a bottom of said housing.

8. The portable bilge pump assembly of claim 2 wherein said housing further comprises a first and second arm, said first and second arms extending outwardly from said end portion of said housing, said first and second arms being pivotally coupled to said pump member.

9. The portable bilge pump assembly of claim 8, further comprising a shroud member, said shroud member being substantially arcuate, said shroud member extending from said first arm to said second arm for protecting an electrical wire extending from said housing to said pump member.

10. The portable bilge pump assembly of claim 2, further comprising:

a clip member extending from a medial portion of the housing, said clip member being for retaining said hose member in a relatively static position in relationship to said housing.

11. A portable bilge pump assembly comprising:

a pump member, said pump member being submersible and adapted for pumping water;

a hose member environmentally coupled to said pump member and adapted for carrying water from said pump member to an area selected by the user for dumping;

a handle assembly pivotally coupled to said pump member, said handle member being for positioning said pump member;

wherein said handle assembly further comprises:

a housing, said housing being substantially elongate, said housing being substantially tubular, said housing having an end portion and a tubular perimeter wall extending from said end portion, said tubular perimeter wall having a distal end, said distal end having an exterior surface with threads applied thereon;

a cap member having a circular end portion and a perimeter wall extending therefrom, said perimeter wall having an interior surface with threads applied thereon such that said cap member is threadedly engageable to said housing;

an o-ring member positioned between said cap member and said housing, said o-ring member providing an environmental barrier between an external environment and an interior of said housing;

a clip member extending from a medial portion of the housing, said clip member being for retaining said hose member in a relatively static position in relationship to said housing;

a electrical energy storage assembly positioned within said housing, said electrical energy storage assembly providing electrical power for said pump member;

wherein said electrical storage assembly comprises a plurality of standard C-cell batteries electrically connected in series;

a switch member, said switch member being positioned in an aperture extending through said perimeter wall of said housing, said switch member being electrically connected between said pump member and said electrical storage assembly such that when said switch member is in a closed position said pump member operates and when said switch member is in an open position said pump member does not operate;

a biasing assembly adapted for urging said electrical storage assembly towards an electrical contact positioned at a bottom of said housing;

a first and second arm, said first and second arms extending outwardly from said end portion of said housing, said first and second arms being pivotally coupled to said pump member; and a shroud member, said shroud member being substantially arcuate, said shroud member extending from said first arm to said second arm for protecting an electrical wire extending from said housing to said pump member.

* * * * *